US007478805B2

(12) United States Patent
Liu et al.

(10) Patent No.: US 7,478,805 B2
(45) Date of Patent: Jan. 20, 2009

(54) DEVICE FOR PAPER SEPARATING AND GUIDING

(75) Inventors: Jen-Chieh Liu, Danshuei Township, Taipei County (TW); Chun-Liang Liu, Banciao (TW)

(73) Assignee: Lite-On Technology Corporation, Taipei (TW)

( * ) Notice: Subject to any disclaimer, the term of this patent is extended or adjusted under 35 U.S.C. 154(b) by 75 days.

(21) Appl. No.: 11/591,574

(22) Filed: Nov. 2, 2006

(65) Prior Publication Data

US 2007/0262514 A1 Nov. 15, 2007

(30) Foreign Application Priority Data

May 10, 2006 (TW) ..... 95208026 U

(51) Int. Cl.
*B65H 3/52* (2006.01)

(52) U.S. Cl. ..... 271/121; 271/167

(58) Field of Classification Search ..... 271/121, 271/122, 167

See application file for complete search history.

(56) References Cited

U.S. PATENT DOCUMENTS

| | | | | |
|---|---|---|---|---|
| 4,815,724 | A * | 3/1989 | Sumida et al. | 271/121 |
| 5,104,113 | A * | 4/1992 | Kameyama et al. | 271/124 |
| 6,948,710 | B2 * | 9/2005 | Togashi et al. | 271/124 |
| 7,163,202 | B2 * | 1/2007 | Togashi et al. | 271/121 |
| 7,270,322 | B2 * | 9/2007 | Chikumoto | 271/121 |
| 2003/0085508 | A1 * | 5/2003 | Fukuchi | 271/121 |
| 2004/0124577 | A1 * | 7/2004 | Lin et al. | 271/121 |
| 2004/0169326 | A1 * | 9/2004 | Nakano et al. | 271/121 |
| 2005/0067758 | A1 * | 3/2005 | Seki et al. | 271/121 |

* cited by examiner

*Primary Examiner*—Kaitlin S Joerger
(74) *Attorney, Agent, or Firm*—Rabin & Berdo, P.C.

(57) ABSTRACT

A device for paper separating and guiding is provided for separating a first paper sheet from a plurality of second paper sheets, and guiding the first paper sheet into a paper-feeding apparatus. The device includes a first inclined surface and a second inclined surface adjacent to each other. The first inclined surface is used for arranging the first paper sheet and a part of the second paper sheets stepwise, so that the first paper sheet located at the top layer is protruding forwards. The second inclined surface is used for blocking the other second paper sheets to maintain the paper sheets on the first inclined surface to be arranged stepwise, so that the process for paper separating and guiding is accomplished.

10 Claims, 5 Drawing Sheets

DEVICE FOR PAPER SEPARATING AND GUIDING

CROSS-REFERENCE TO RELATED APPLICATIONS

This non-provisional application claims priority under 35 U.S.C. § 119(a) on Patent Application No(s). 095208026 filed in Taiwan, R.O.C. on May 10, 2006, the entire contents of which are hereby incorporated by reference.

BACKGROUND OF THE INVENTION

1. Field of Invention

The present invention relates to an automatic paper-feeding apparatus, and more particularly to a device for paper separating and guiding, which is disposed at the paper inlet of the automatic paper-feeding apparatus for assisting the pickup of paper sheets.

2. Related Art

A paper pickup device is required to be disposed at the paper inlet of an automatic paper-feeding apparatus, for sequentially feeding overlapped paper sheets into the automatic paper-feeding device one by one. Therefore, a mechanism for assisting the paper separating and guiding is required within the paper pickup device, for separating the paper sheets one by one and ensuring them to enter into the paper-feeding apparatus sequentially. Generally, errors in allocating paper sheets include, for example, 1. multi-feed: two or more than two paper sheets are picked up during the paper feeding; 2. miss-feed: no paper sheets are fed due to different thicknesses of paper sheets; 3. paper jam and paper blocked: the paper feeding is interrupted due to different sizes and thicknesses of the paper sheets. In order to ensure the sequent process of printing, photocopy, and scanning to be performed smoothly, the device for paper separating and feeding must be improved, so as to avoid the above mentioned errors.

The mechanism for paper separating and guiding generally feeds a paper sheet on the top of overlapped paper sheets into a multifunctional peripheral (MFP) through the rotation of a paper pickup roller. The paper pickup roller generally has a rugged surface for frictionally driving the paper sheet. On the other aspect, in order to avoid taking along more than one paper sheet due to the friction force, a paper separating device is require to assist the process of pickup and feeding paper sheets. The most common paper separating and feeding methods are: (1) buckle-type paper separating: paper sheets are separated and by the rigidity of the paper sheets themselves; (2) paper separating through a roller: the separating and feeding of paper sheet is achieved by a paper separating roller and a paper pickup roller rotating towards opposite directions; (3) paper separating through a frictional pad: the othe separating and feeding of paper sheet is achieved by difference of the friction coefficient between a frictional pad and the roller.

As shown in FIG. 1, it is a schematic view of a paper separating and guiding device with a frictional pad to separate paper sheets in the prior art. The multi-feed phenomenon is shown in the figure. When the friction force between the paper sheets to be fed 40 is larger than that between a paper sheet 40*a* to be fed first and a paper pickup roller 10, the paper sheet 40*a* to be fed first and the other paper sheets to be fed 40*b* are together fed into the space between the paper pickup roller 10 and the paper separating device 20, thus the phenomenon of multi-feed occurs. The normal force of the paper separating sheet 20 pressing against the paper pickup roller 10 is provided by an elastic element 25, and the elasticity is fixed, thus, it cannot be adjusted timely according to the roughness and thickness of the paper. Therefore, when the thicknesses or types of the paper sheets are different from the default values, the phenomenon of multi-feed easily occurs, and it also occurs when adopting the paper separating and guiding mechanism using a roller. The buckle-type paper separating mechanism is also influenced by the thickness or type of the paper, such that the phenomenon of multi-feed or paper jam occurs.

SUMMARY OF THE INVENTION

In view of the above problems, an object of the present invention is to provide a device for paper separating and guiding, for reducing the probability of multi-feed or paper jam phenomenon.

In order to achieve the above object, the present invention provides a device for paper separating and guiding, corresponding to a paper pickup roller of a paper-feeding apparatus. The device for paper separating and guiding has a top surface, a first inclined surface, and a second inclined surface. The first inclined surface is adjacent to the top surface, and forms a first inclined angle with the top surface. The second inclined surface is adjacent to the other side edge of the first inclined surface and forms a second inclined angle with the top surface. The second inclined angle is larger than the first inclined angle. When paper sheets to be fed contact with the device for paper separating and guiding, the process of paper separating is achieved by the angle difference between the two inclined surfaces. The first inclined surface with the first inclined angle is used for arranging the paper sheets to be fed stepwise sequentially, and guiding the first paper sheet on top of the paper sheets to be fed to move towards the top surface, while the other paper sheets to be fed are blocked on the second inclined surface. Then, the first paper sheet on the first inclined surface is fed forwards due to the rotation of the paper pickup roller in contact with the device for paper separating and guiding.

The paper feeding mechanism emphasizes the stability in the operations of separating and delivering paper sheets, and the assembly procedure and manufacturing cost are important factors for promoting the competitiveness of the product. Therefore, the present invention has the advantages of simple assembly procedures and low cost, thus, not only achieving the operations of separating and feeding paper sheets indeed, but also reducing the manufacturing cost.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only for, which thus is not limitative of the present invention, and wherein.

DETAILED DESCRIPTION OF THE INVENTION

In order to further understand the objects, structures, features, and functions of the present invention, it is illustrated below in detail through the embodiments.

Figure 1:
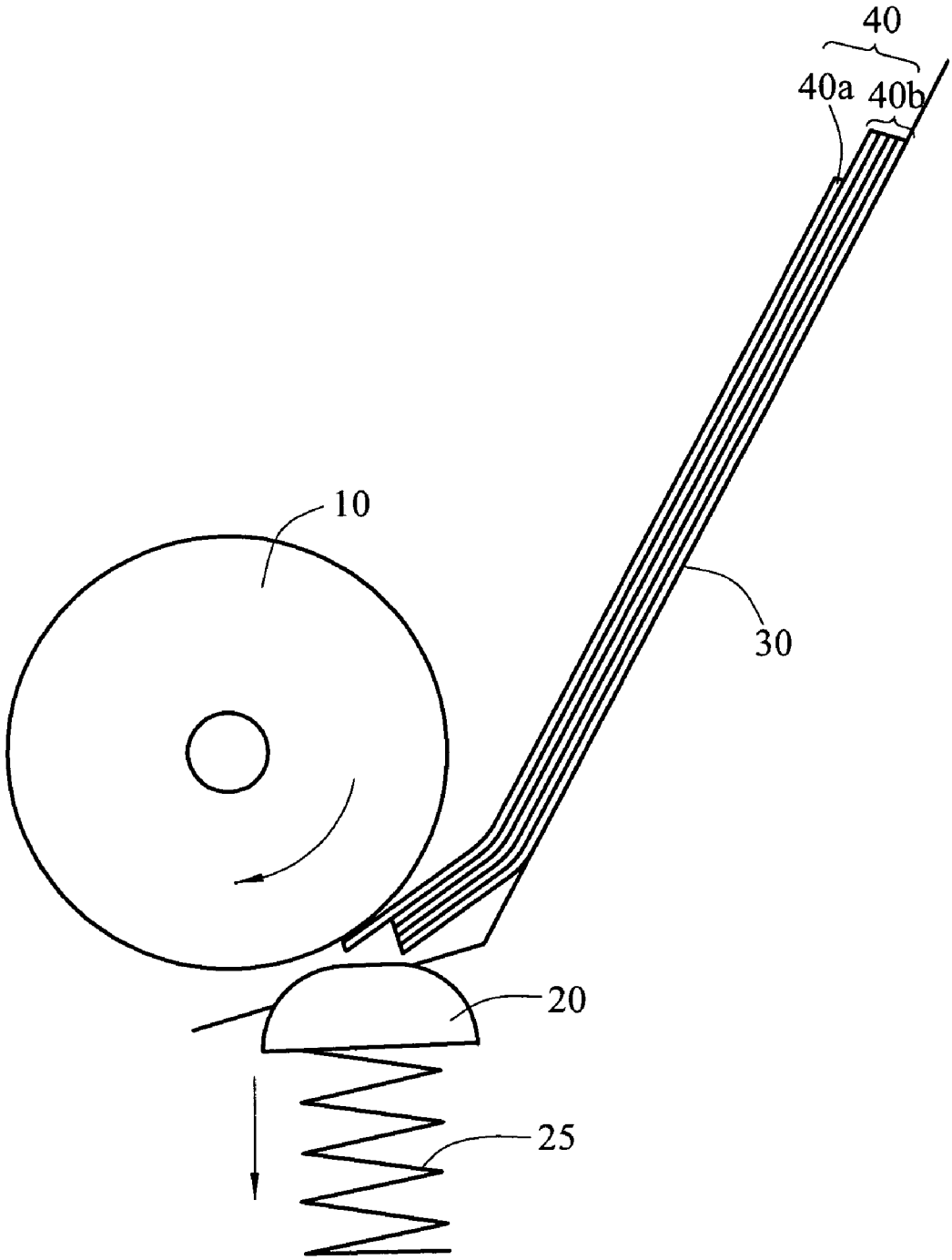
FIG.1 (PRIOR ART)
FIG. 1 is a schematic view of a paper separating and guiding device with a frictional pad in the prior art.
Figure 2:
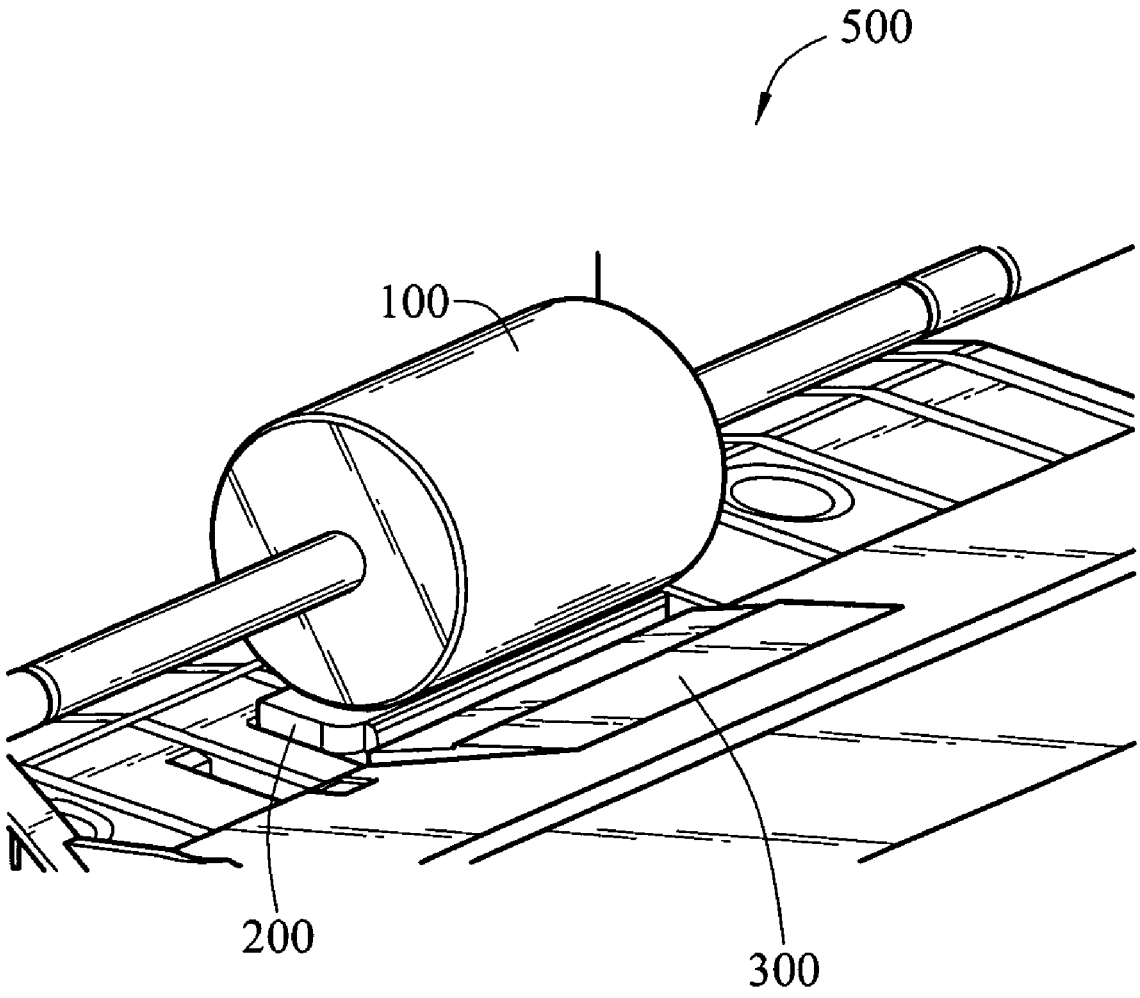
FIG. 2 is a perspective view of a device for paper separating and guiding of the present invention in an automatic paper-feeding device.
Figure 3A:
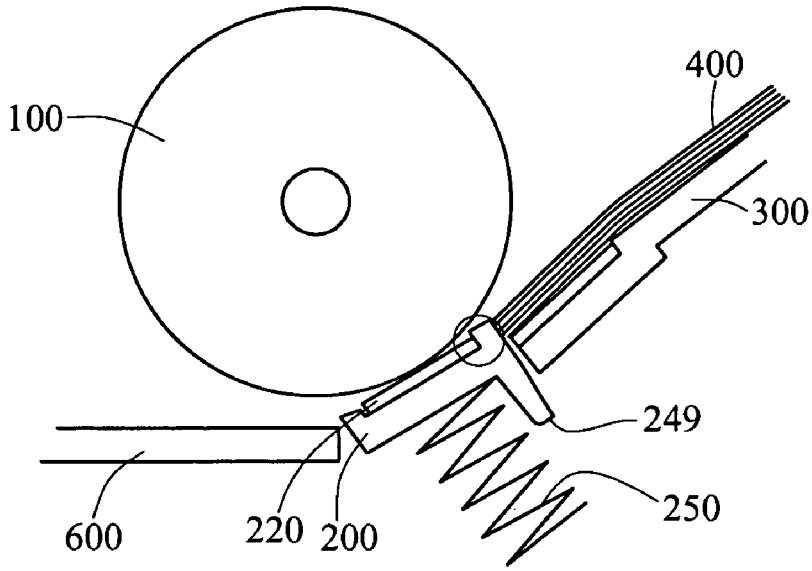
FIG. 3A is a schematic side view of the device for paper separating and guiding of the present invention in the automatic paper-feeding device.
Figure 3B:
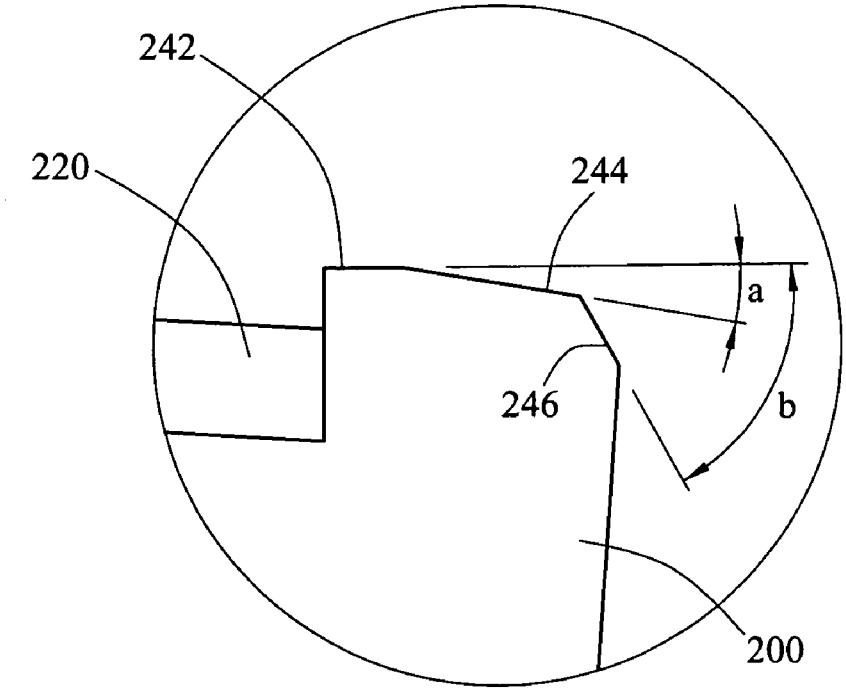
FIG. 3B is an enlarged schematic view of the device for paper separating and guiding of the present invention.

Referring to FIG. 2, FIG. 3A, and FIG. 3B, a device for paper separating and guiding 200 provided in the present invention is applied in a paper-feeding device 500. The paper-feeding device 500 includes a paper pickup roller 100, a device for paper separating and guiding 200, and a paper feeding tray 300.

The paper pickup roller 100 is driven by a motor (not shown), and is rotated as the motor rotates. An elastic element 250 is connected to the device for paper separating and guiding 200 for pushing it to press against the paper pickup roller 100, and makes the paper pickup roller 100 closely contact with the paper sheets to be fed 400, and feeds the paper sheets to be fed 400 together with the paper pickup roller 100.

The paper feeding tray 300 is an inclined surface for supporting the paper sheets to be fed 400. The paper sheets to be fed 400 slide downwards along the surface of the paper feeding tray 300 under the effect of the gravity and is positioned until their front edges contact with the device for paper separating and guiding 200, as shown in FIG. 4A.

Figure 4A:
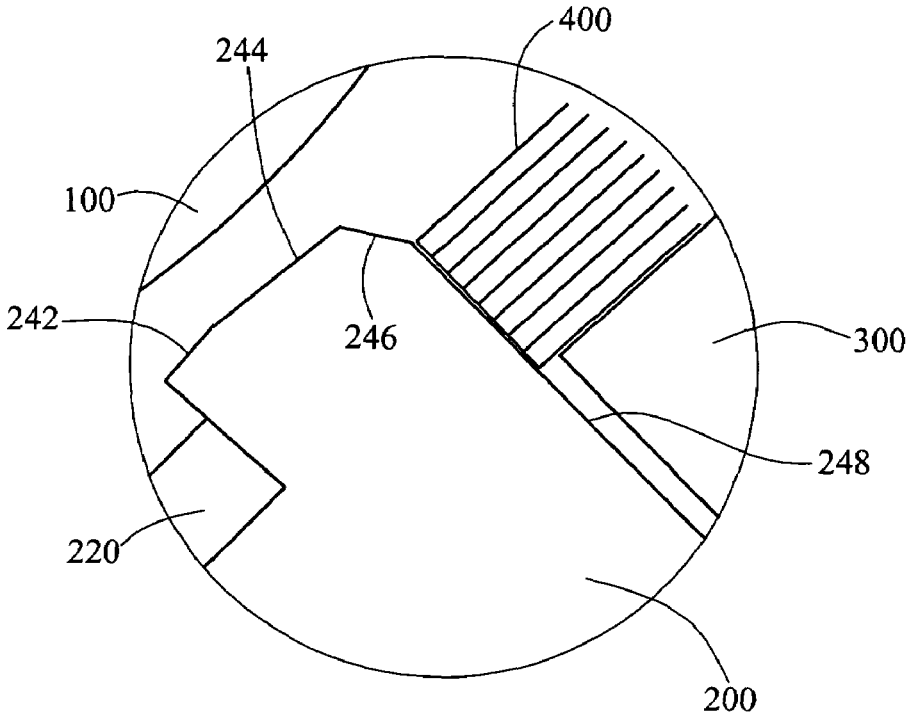
FIG. 4A is an enlarged schematic view of the device for paper separating and guiding of the present invention before the paper sheets are separated.

Referring to both FIG. 3B and FIG. 4A, FIG. 3B is an enlarged schematic view of the device for paper separating and guiding of the present invention, and FIG. 4A is an enlarged schematic view of the device for paper separating and guiding of the present invention before the paper sheets are separated. An elastic pad 220 is disposed on the top surface 242 of the device for paper separating and guiding 200 facing the paper pickup roller 100, which is made of elastic materials, for example, rubber. Moreover, the outer edge of the paper pickup roller 100 is also made of elastic materials, for example, rubber. Due to the elastic pad 220 and the paper pickup roller 100 having elasticity, an appropriate normal force is generated between the device for paper separating and guiding 200 and the paper pickup roller 100, such that the paper sheets are clipped between the device for paper separating and guiding 200 and the paper pickup roller 100 under an appropriate force. Meanwhile, the paper pickup roller 100 made of elastic materials can also be used to enhance the friction force with the paper sheets, such that the paper pickup roller 100 drives the paper sheets smoothly.

One side edge of the top surface 242 of the device for paper separating and guiding 200 far away from the elastic pad 220 has a first inclined surface 244 forming a first inclined angle a between 10° to 15° with the top surface 242, which is used for arranging the paper sheets stepwise sequentially, such that the paper sheet on the top is protruding forwards. A second inclined surface 246 is adjacent to the other side edge of the first inclined surface 244, and forms a second inclined angle b with the top surface 242. The second inclined angle b must be larger than the first inclined angle a, thus, the second inclined angle b is in the range of 65° to 75°. The second inclined surface 246 is mainly used for blocking the paper sheets to avoid excessive paper sheets sliding to the first inclined surface 244 and the top surface 242 at the same time, so as to prevent the stepwise arrangement of the paper sheets from being affected. Moreover, the device for paper separating and guiding 200 is made of plastic, thus it can be manufactured by the way of injection molding, to accurately control its size. Furthermore, since the plastic is used, the manufacturing cost is relatively low.

Referring to FIG. 4A, it is an enlarged schematic view of the device for paper separating and guiding of the present invention before the paper sheets are separated. The paper feeding tray 300 is a surface inclined downwards. The paper sheets to be fed 400 slide downwards along the surface of the paper feeding tray 300 under the effect of gravity, and are positioned until their front edges contact with the device for paper separating and guiding 200, i.e. the front edges of the paper sheet contact with the third inclined surface 248 between the second inclined surface 246 and the bottom surface 249. At this time, the front edges of the paper sheets to be fed 400 are aligned evenly.

Figure 4B:
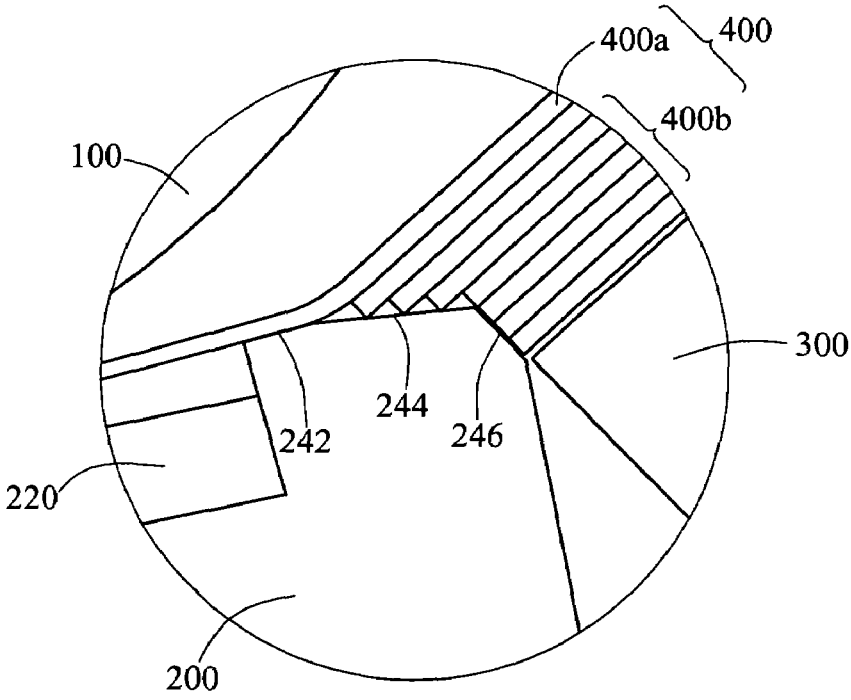
FIG. 4B is an enlarged schematic view of the device for paper separating and guiding of the present invention in the paper separating state.

Next, referring to FIG. 4B, it is an enlarged schematic view of the device for paper separating and guiding of the present invention in the paper separating state. When the paper pickup roller 100 rotates clockwise to pickup paper sheets, it pushes the device for paper separating and guiding 200 to be inclined, such that the front edges of the paper sheets to be fed 400 slide towards the first inclined surface 244. At this time, the first paper sheet 400*a* on the top and the front edges of a part of the second paper sheets 400*b* enter the first inclined surface 244, such that the first paper 400*a* and the part of the second paper sheets 400*b* are arranged stepwise sequentially, and the first paper sheet 400*a* is guided to move towards the top surface 242. The second inclined surface 246 blocks a part of the second paper sheets 400*b* to avoid excessive paper sheets sliding into the first inclined surface 244, wherein and excessive paper sheets cause difficulty in paper separating. Finally, on the first inclined surface 244, the first paper sheet 400*a* is protruding more outwards than other second paper sheets 400*b*, thus, only the first paper 400*a* can enter the top surface 242 and contact with the paper pickup roller 100, thereby completing the operation of paper separating.

Figure 5:
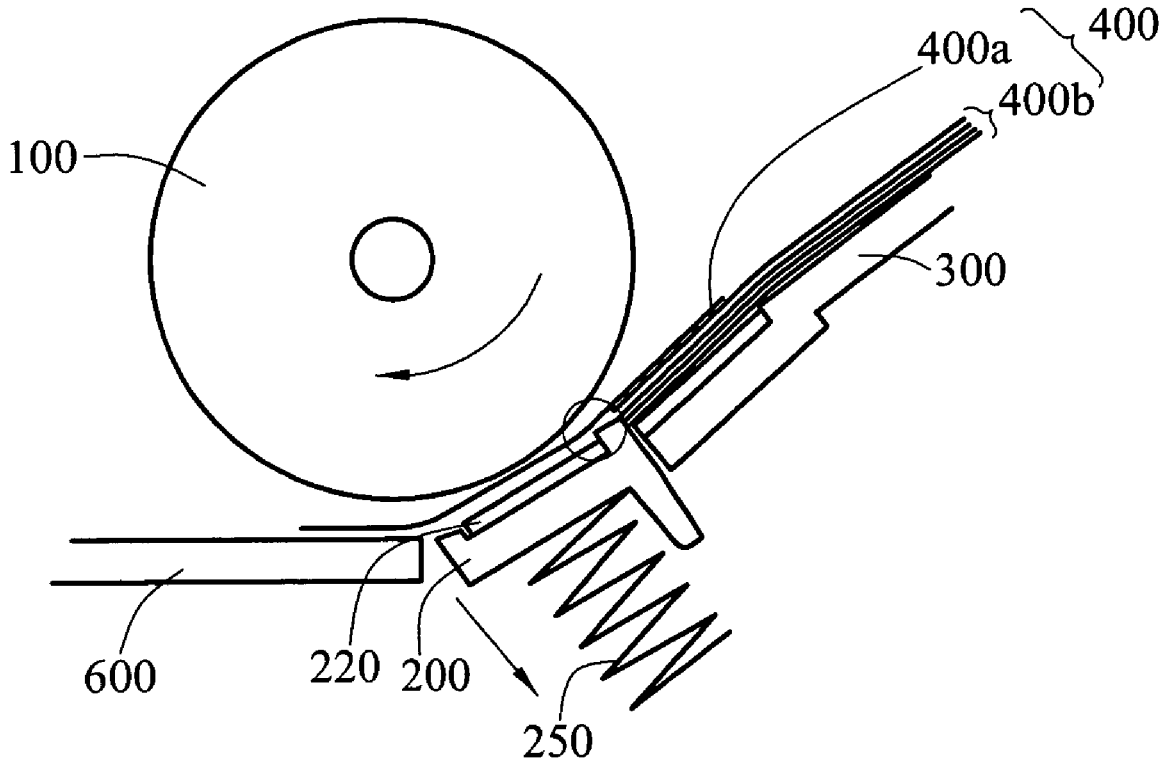
FIG. 5 is a schematic view of the process of delivering paper sheets of the present invention.

Referring to FIG. 5, it is a schematic view of the process of feeding paper sheets of the present invention. The paper pickup roller 100 starts to rotate and drives the first paper 400*a* on the top surface 242 to be transmitted towards a paper guiding rail 600.

Since the automatic paper-feeding apparatus emphasizes the stability in the operations of separating and delivering paper sheets, the first inclined surface 244 of the present invention makes the first paper sheet 400*a* to be fed be protruding outwards relative to other paper sheets, and only the first paper sheet 400*a* contacts with the paper pickup roller 100, thus avoiding the problem of multi-feed. Meanwhile, in order to ensure that the paper sheets to be fed 400 are arranged stepwise, the present invention further provides a design of the second inclined surface 246 for preventing excessive paper sheets from entering to the first inclined surface 244 at the same time, such that the paper sheets to be fed 400 are accurately arranged stepwise, thereby further reducing the probability of multi-feed or paper jam.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A device for paper separating and guiding, applied in a paper-feeding apparatus, wherein the paper-feeding apparatus has a paper pickup roller corresponding to the device for paper separating and guiding, for conveying a plurality of overlapped paper sheets, the device for paper separating and guiding comprising:

a top surface, facing the paper pickup roller;

a first inclined surface corresponding to front edges of the paper sheets, connected to the top surface, forming a first inclined angle with the plane of the top surface, and used for arranging the paper sheets stepwise sequentially a second inclined surface, connected to the first inclined surface, and forming a second inclined angle with the plane of the top surface;

a third inclined surface, connected to the second inclined surface, wherein the first inclined surface, the second inclined surface and the third inclined surface are on the same lateral side of the top surface; and a bottom surface opposite to the top surface and connected to the third inclined surface.

2. The device for paper separating and guiding according to claim 1, wherein an elastic pad is disposed on the top surface.

3. The device for paper separating and guiding according to claim 1, wherein the device for paper separating and guiding is made of plastic.

4. The device for paper separating and guiding according to claim 1, wherein the first inclined angle is between 10° to 15°.

5. The device for paper separating and guiding according to claim 1, wherein the second inclined angle is between 65° to 75°.

6. A paper-feeding device, comprising:

a paper feeding tray, for supporting paper sheets;

a paper pickup roller, corresponding to a front edge of the paper sheets; and a device for paper separating and guiding, corresponding to the paper pickup roller and pushed to be inclined toward the paper feeding tray when the paper pickup roller rotates, comprising:

a top surface, facing the paper pickup roller;

a first inclined surface, connected to the top surface and forming a first inclined angle with the top surface;

a second inclined surface, connected to the first inclined surface and forming a second inclined angle with the top surface; and a third inclined surface connected to the second inclined surface and contacted with the front edge of the paper sheets, wherein the first inclined surface, the second inclined surface and the third inclined surface are on the same lateral side of the top surface;

when the device for paper separating and guiding is inclined, the paper sheets are separated from the third inclined surface, at least some of the paper sheets are contacted with the second inclined surface and the others are contacted with the first inclined surface.

7. The paper-feeding device according to claim 6, further comprising an elastic element for pushing the device for paper separating and guiding to press against the paper pickup roller.

8. The paper-feeding device according to claim 6, wherein an elastic pad is disposed on the top surface of the device for paper separating and guiding.

9. The paper-feeding device according to claim 6, wherein the first inclined angle is between 10° to 15°.

10. The paper-feeding device according to claim 6, wherein the second inclined angle is between 65° to 75°.

* * * * *